US007052242B2

(12) United States Patent
Chen

(10) Patent No.: US 7,052,242 B2
(45) Date of Patent: May 30, 2006

(54) MULTI-FAN ASSEMBLY COMPRISING A SERVOMOTOR DRIVEN VERTICAL OSCILLATION MEANS FOR EACH FAN

(76) Inventor: Chia-Teh Chen, 5Fl., No. 30, Yi Shian Rd., Sung Shan Chiu, Taipei (TW)

( * ) Notice: Subject to any disclaimer, the term of this patent is extended or adjusted under 35 U.S.C. 154(b) by 230 days.

(21) Appl. No.: 10/719,346

(22) Filed: Nov. 21, 2003

(65) Prior Publication Data

US 2004/0191065 A1 Sep. 30, 2004

(51) Int. Cl.
*B64C 11/16* (2006.01)

(52) U.S. Cl. ..... 416/423.3; 416/99; 416/100; 416/110; 416/123; 416/130; 416/5; 417/423.15; 417/423.3; 417/423.5

(58) Field of Classification Search ..... 417/423.15, 417/423.3, 423.5; 416/5, 99, 100, 110, 123, 416/130
See application file for complete search history.

(56) References Cited

U.S. PATENT DOCUMENTS

| | | | | |
|---|---|---|---|---|
| 1,409,090 | A * | 3/1922 | Glasser | 416/83 |
| 1,577,461 | A * | 3/1926 | Glasser | 416/83 |
| 4,730,981 | A * | 3/1988 | Kawai | 416/83 |
| 6,364,638 | B1 * | 4/2002 | Liu | 417/423.15 |
| 6,772,589 | B1 * | 8/2004 | Schienbein et al. | 60/421 |
| 6,817,830 | B1 * | 11/2004 | Chen | 415/60 |
| 6,832,902 | B1 * | 12/2004 | Gajewski et al. | 417/423.3 |
| 6,913,443 | B1 * | 7/2005 | Chen | 416/99 |

* cited by examiner

*Primary Examiner*—Timothy S. Thorpe
*Assistant Examiner*—Emmanuel Sayoc
(74) *Attorney, Agent, or Firm*—Charles E. Baxley

(57) ABSTRACT

A multi-fan assembly includes: a down rod assembly having a first end for fixing to a ceiling wall and having a second end provided with a canopy, a rotary assembly being fixed to a lower end of the down rod assembly and covered by the canopy. At both sides of the rotary assembly is provided with a fixed arm for connecting with a member fan respectively, a pair of vertical oscillating means are disposed between the fixed arm and the member fan, and a speed control device is mounted on the rotary assembly and then covered by the canopy of the down rod assembly.

3 Claims, 5 Drawing Sheets

MULTI-FAN ASSEMBLY COMPRISING A SERVOMOTOR DRIVEN VERTICAL OSCILLATION MEANS FOR EACH FAN

BACKGROUND OF THE INVENTION

1. Field of the Invention

The present invention relates to a multi-fan assembly, and more particularly to a multi-fan assembly wherein the member fans of which can vertically oscillate while revolving about the common shaft of the multi-fan assembly, both of the pitching angle and the revolution of the member fans can be adjusted and fixed instantly by method of remote control or wire control.

2. Description of the Prior Arts

To avoid confusion during the course of this presentation, here are definitions for some words used in following descriptions as below:

Rotation: the spinning of fan blades of the member fan rounds its own axis or the circular movement of a rotatable member moving round a central shaft.

Revolution: the circular movement of two or more member fans rotating about a common central main shaft.

Cooling frequency: the member fan to finish a whole circle revolution.

Conventional multi-fan assembly is normally provided with two or more member fans 91 at outside of a rotary assembly 92 (as shown in FIG. 1) so as to provide cooling air from multi-direction or by radial way. The pitching angle of the member fan 91 is adjusted and fixed by manual way via a fixing member. This kind of multi-fan assembly is able to provide good effect of blowing air, however, there are still some disadvantages of which need to be improved as follows:

First, due to the pitching angle of the member fans 91 is fixed and unchangeable during the revolution of the rotary assembly 92, the cooling effect of the multi-fan assembly of this kind is limited.

Second, since the pitching angle of the member fans 91 only can be adjusted by manual way, it is very laborsome and time-consuming.

Third, the revolution speed is unadjustable. If the revolution speed is fixed, the users sitting around a bigger table will enjoy less cooling airflow provided by the member fans 91 than the users who sit around a smaller table. That is to say, the revolution speed should be adjusted at a direct proportion to the working radius of the member fans 91, so as to provide enough airflow for the respective users. The revolution of the conventional multi-fan assembly is driven by the rotation of the member fans, it is found in practices that the bigger the working radius of the member fans is, the slower the revolution speed will be, and vice versa. However, this characteristic of the conventional multi-fan assembly just runs counter to the user's needs. In order to maintain a constant cooling frequency, the bigger table with larger working radius need to revolve at a faster speed, so that the sitting persons around the bigger table will enjoy the same frequency of cooling effect.

The present invention has arisen to mitigate and/or obviate the afore-described disadvantages of the conventional multi-fan assembly.

SUMMARY OF THE INVENTION

The primary object of the present invention is to provide a multi-fan assembly having plural member fans, besides being capable of overcoming the above-mentioned disadvantages, which still has the distinct functions as follows:

1. A cover of motor of the multi-fan assembly according to the present invention is interiorly provided with an oscillating means consisting of a servomotor, a gear cluster and a connecting rod, by such arrangements, the member fans can be controlled by method of remote control or by wire to oscillate vertically, such that together with the revolving function of the multi-assembly, the member fans are able to provide cooling air by method of vertical oscillation as well as horizontal revolution, that is to provide cool air at a full three dimensional circumferential angle.

2. The vertical oscillation of the member fans are driven by the servomotor, when the current of the servomotor is cut off, the vertical oscillation motion of the member fans will be stopped instantly, by this way, the pitching angle of the member fans is fixed instantly. And this can be done by method of remote control or by wire, such that overcomes the inconveniences of prior art that is fixed by manual.

3. On a rotary assembly of the multi-fan assembly of the present invention is provided with a speed control unit, which including: a motor, a gear cluster and a current control unit. The current control unit controls the current so as to control the rotating speed of the motor, through the differential motion of the gear cluster, the rotary assembly is driven to revolve. The stronger the current is, the faster the revolution will be. By this way, the revolution speed of the multi-fan assembly can be adjusted and controlled and it can be controlled by method of remote control or by wire control.

4. In a like manner as 2, the revolution of the multi-fan assembly of the present invention can be stopped by cutting off the current, such that horizontal revolution can be instantly stopped and fixed at any position according to user's needs.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
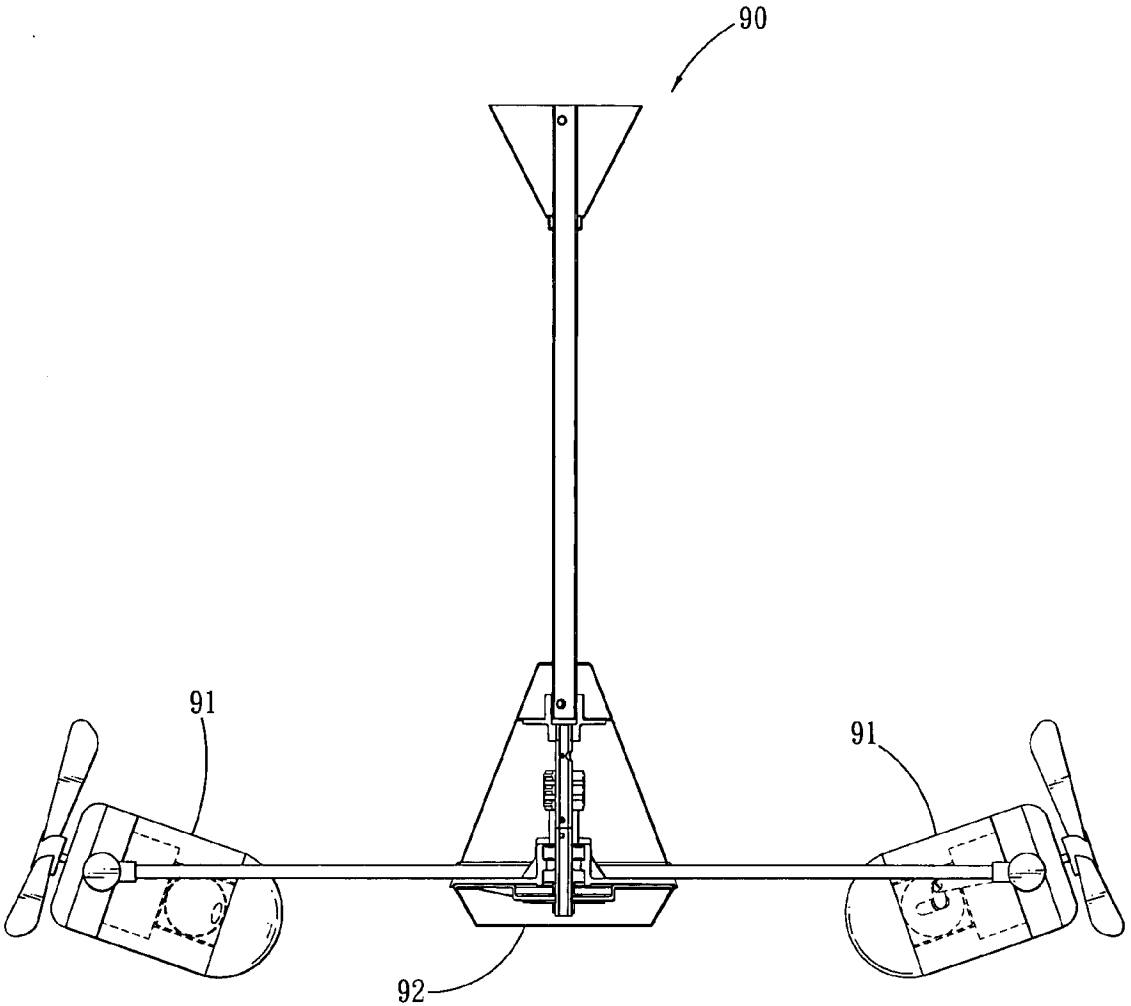
FIG. 1 PRIOR ART
FIG. 1 is a cross-sectional view of a conventional multi-fan assembly.
Figure 2:
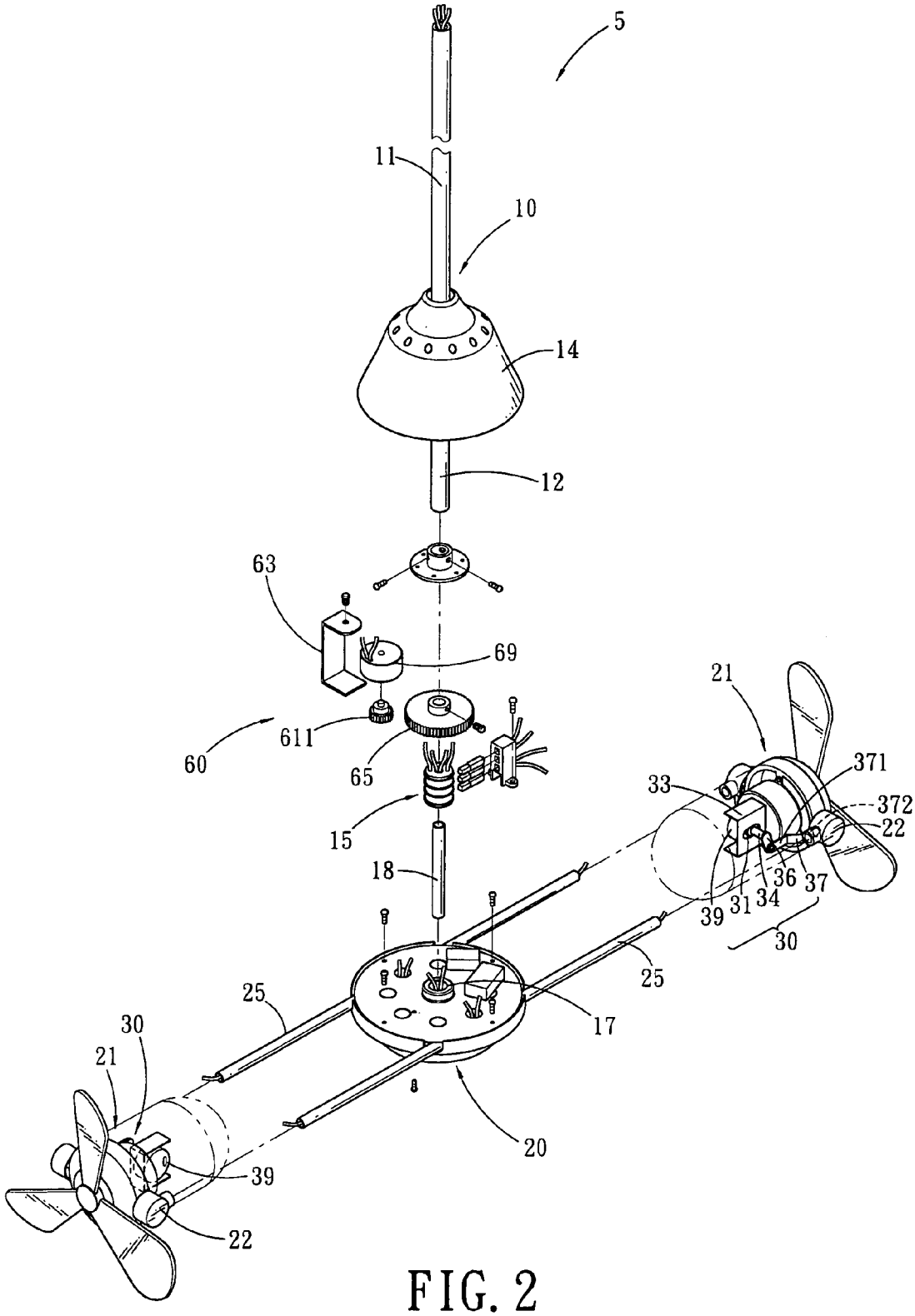
FIG. 2 is an exploded view of a multi-fan assembly in accordance with a first embodiment of the present invention.
Figure 3:
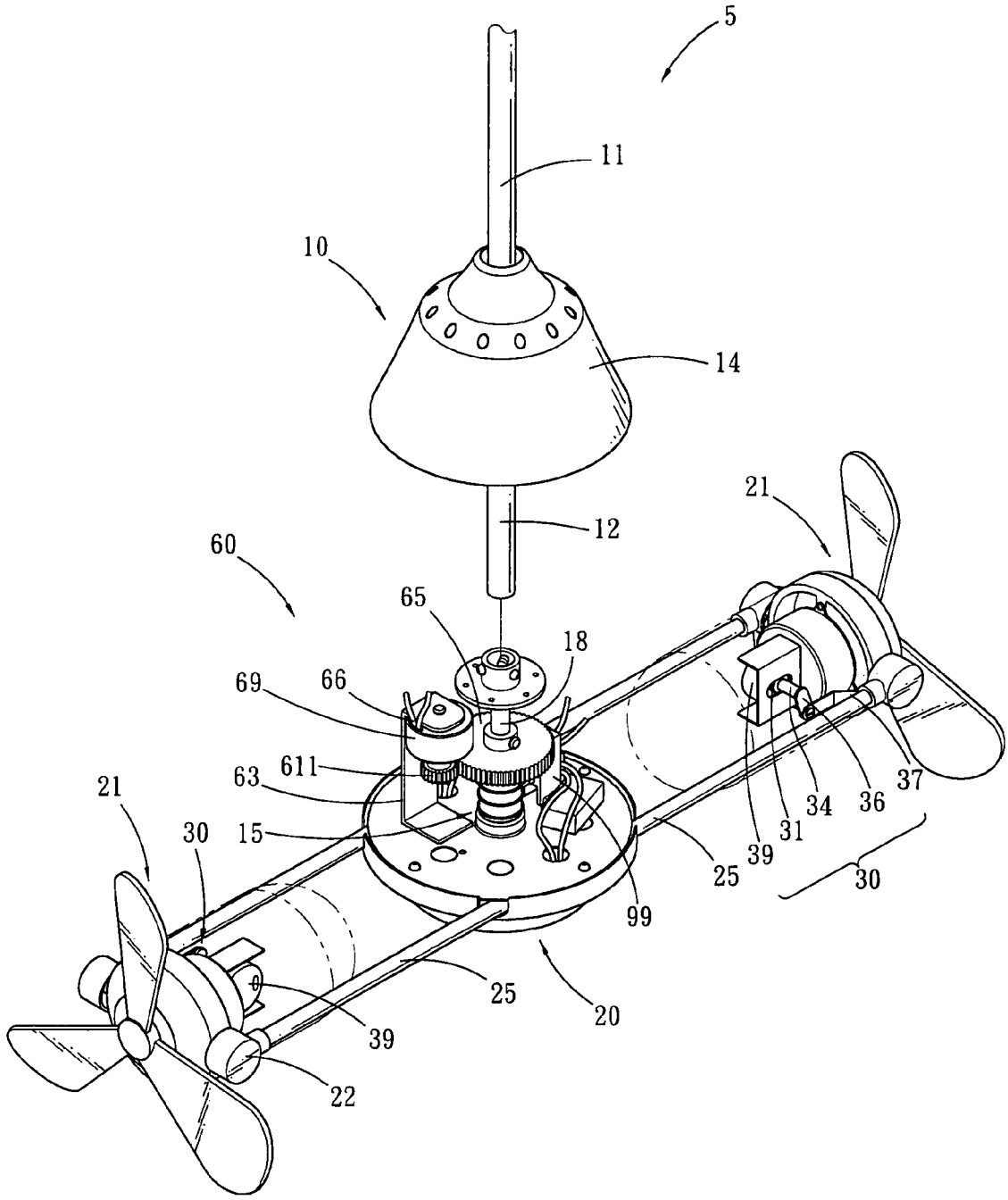
FIG. 3 is a perspective assembly view of the multi-fan assembly in accordance with the first embodiment of the present invention.

Referring to FIGS. 2–5, wherein a multi-fan assembly 5 in accordance with a first embodiment of the present invention is shown and generally comprising: a down rod assembly 10, a rotary assembly 20, a pair of vertical oscillating means 30 and a speed control device 60.

The down rod assembly 10 includes a down rod 11 and a shaft 12. The down rod 11 has a first end for fixing to ceiling wall and has a second end provided with a canopy 14. Inside of the canopy 14 thereof a transmission unit 15 is disposed. The shaft 12 is connected to the second end of the down rod 11 and covered by the canopy 14.

The rotary assembly 20, via a shaft bearing 17, is fixed to the lower end of the shaft 12 of the down rod assembly 10 and the canopy 14 of the down rod assembly 10 covers the top end of the rotary assembly 20. At both sides of the rotary assembly 20 fixed arms 25 are disposed respectively, on each fixed arm 25 is provided with a member fan 21, which is fixed thereon by virtue of a hanging device 22 respectively. The hanging device 22 (such as oil-impregnated bearing) allows free oscillation of the fans, such that both of the member fans 21 are able to provided cool air at a full circumferential angle in case of 360 degree-revolution of the rotary assembly 20.

The vertical oscillating means 30 are disposed between the fixed arm 25 of the rotary assembly 20 and the member fan 21, each comprises a servomotor 39, a gear cluster 31, a crank 34, a connecting rod 36 and a rocker lever 37. The servomotor 39 and the gear cluster 31 are disposed at the rear end of the member fan 21 of the rotary assembly 20 by virtue of a bracket 33. The crank 34 has a first end for engaging with the gear cluster 31, the connecting rod 36 is fixed to another a second end of the crank 34. The rocker lever 37 has a first end 371 connected to the connecting rod 36 and a second end 372 for fixing to the fixed arm 25 of the rotary assembly 20. The servomotor 39 of the vertical oscillating means 30 is applied to effecting differential rotation the gear cluster 31 so as to drive the crank 34, and thus further drives the connecting rod 36 as well as the rocker lever 37 for effecting vertical oscillation of the respective member fans, in this way, the member fans 21 can vertically oscillate when the fixed arms 25 being driven to revolve by the rotary assembly 20, so as to provide cool air at a three dimensional full circumferential angle. In addition, the servomotor 39 of the two oscillating means 30 can be electrically connected to a current control unit operatively associated with the input current of the servomotor 39 by wire or remote control, to further control the rotary speed of the servomotor 39. And again, by virtue of the differential rotation caused by the gear cluster 39, the oscillating speed of the member fans can be controlled, such that achieves the object for easy controlling the oscillating speed of the fans.

Figure 4:
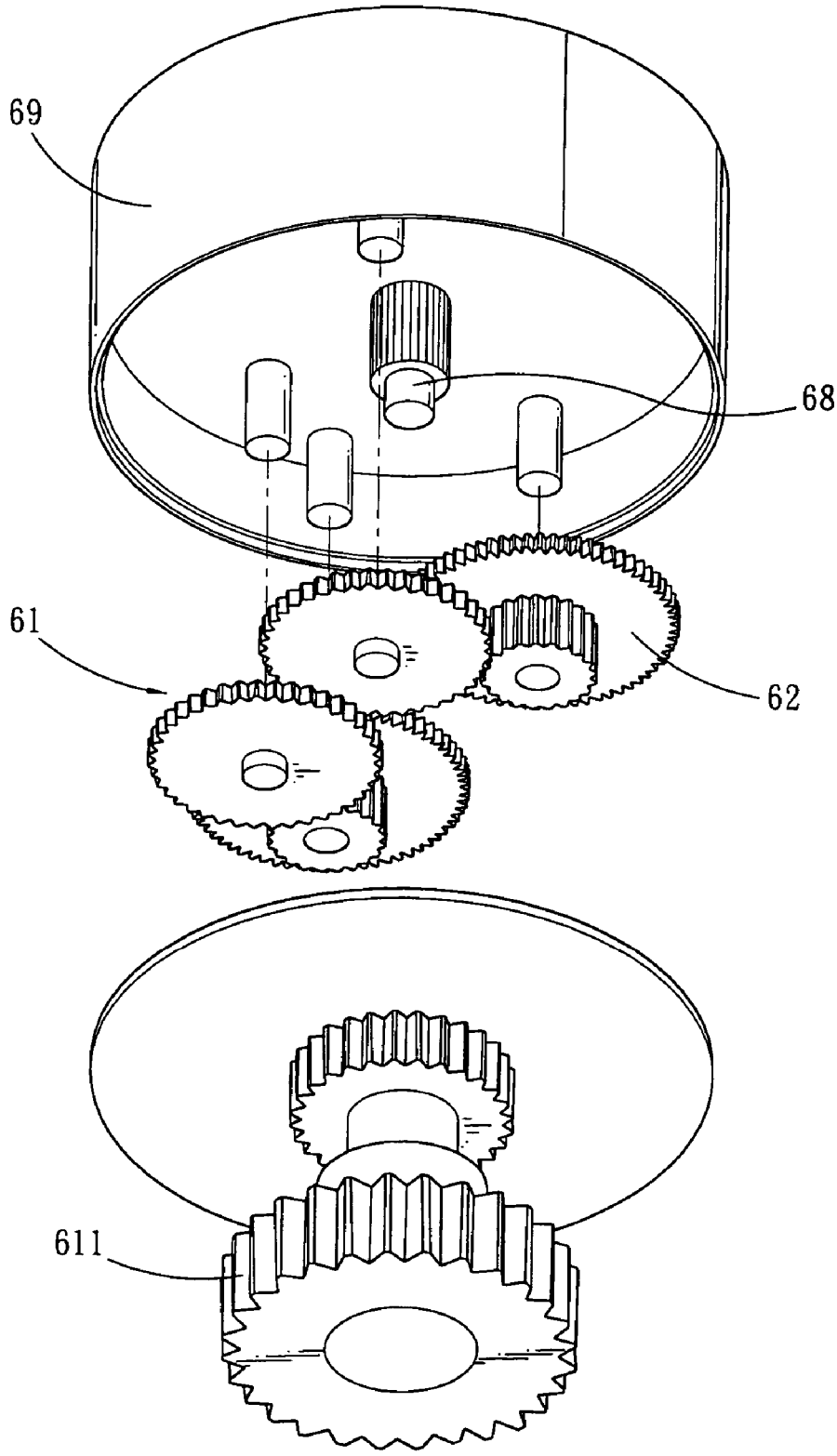
FIG. 4 is a partial exploded view of an oscillating means and speed control device of the multi-fan assembly of FIG. 2.
Figure 5:
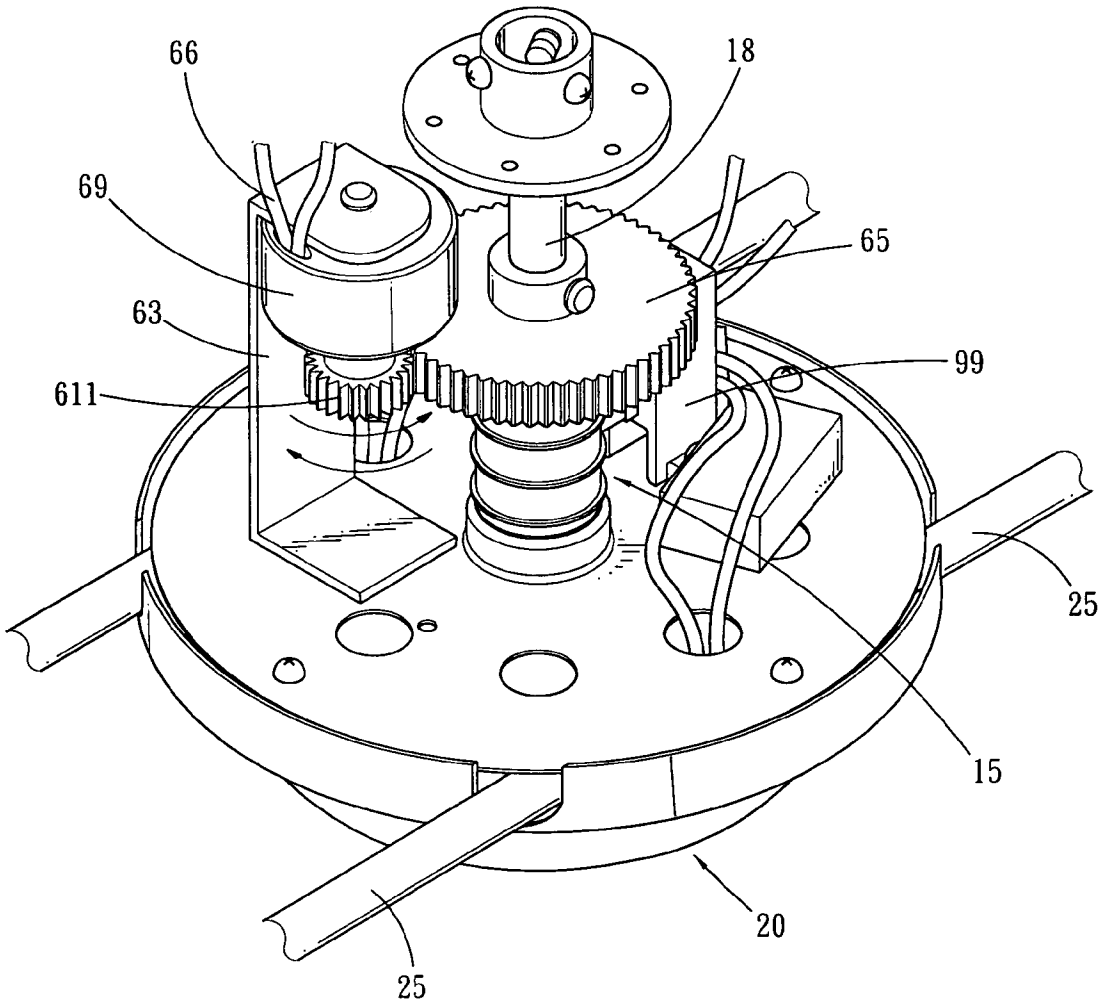
FIG. 5 is a partial amplified view of a speed control device of the multi-fan assembly of FIG. 3.

The speed control device 60 is disposed between the rotary assembly 20 and the axial tube 18 and including a motor 69, a gear cluster 61 consisting of plural gears 62 (as shown in FIG. 4), and a current control unit 66 being electrically connected with the motor 69 and then fixed to the rotary assembly 20. The motor 69 and the gear cluster 61 are fixed to the rotary assembly 20 by virtue of a mounting bracket 63. On the axial tube 18 is mounted with a central axial gear 65 and located above the rotary assembly 20. The central axial gear 65 meshes closely with an output gear 611 of the gear cluster 60. The motor has an output shaft 68 for extending to the gear cluster 61(as shown in FIG. 4), when the current is transmitted from the current control unit 68 to the servomotor 69, the output shaft 68 will drive the gear cluster 61 so as to cause a differential rotation, and thus the output of the cluster 61 is changed from a weak torque at high speed into a strong torque at low speed, such that makes the output gear 611 of the gear cluster 61 rotate about the central axial gear 65, which results in a revolution of the rotary assembly 20. The stronger the current is, the faster the revolution of the rotary assembly will be, and vice versa.

According to the respective functions and characteristics of the oscillating means 30 as well as the speed control device 60 as described above, there are some distinct functions of the present invention can be deduced as follows:

First, the oscillating means and the speed control device can enable the user to freely control the speed of the oscillation as well as the revolution of the member fans, so as to control the airflow rate. Normally, at the beginning of the air conditioner's operation, it needs to quick-adjust the temperature inner the room to a desired degree, thereby both the revolution and rotation of the member fans should be set at a high speed. After the temperature is cooled down to a desired degree, then the revolution and rotation of the member fans can be adjusted at a relative low speed for maintaining constant room temperature. The multi-fan assembly of the present invention provides cooling air at a full three dimensional circumferential angle, and thus the cooling effect of the multi-fan assembly of present invention will be much better than that of the conventional fans.

Second, the pitching angle of the member fans can be adjusted and instantly fixed, such that it is more convenient for the user to adjust the pitching angle of the fans by method of remote control or wire control comparing to the conventional manual method. The member fans can be adjusted according to user's needs to provide cooling air at a desired working radius. Furthermore, the characteristic of the speed control unit can maintain the cooling frequency at a desired level.

Third, the function of instantly fixing the vertical oscillation as well as the horizontal revolution of the multi-fan assembly enables the member fans to provide cooling air to the people sitting in a line or in a row.

Fourth, the function of instant fixing the vertical oscillation as well as the horizontal revolution of the multi-fan assembly enables the member fans to fixedly and continuously blow air to people sitting alone or to two parties of people sitting opposite to each other.

While we have shown and described various embodiments in accordance with the present invention, it should be clear to those skilled in the art that further embodiments may be made without departing from the scope of the present invention.

What is claimed is:

1. A multi-fan assembly having plural member fans capable of revolving around the common central shaft and oscillating vertically, comprising:

a down rod assembly including a down rod and a shaft, the down rod having a first end for fixing to ceiling wall and having a second end provided with a canopy, inside of the canopy a transmission unit being disposed, the shaft having a top end connected to the second end of the down rod and covered by the canopy;

a rotary assembly, via a shaft bearing, fixed to the lower end of the shaft of the down rod assembly, at both sides of the rotary assembly provided with a fixed arm respectively, on each fixed arm provided with a member fan for providing cool air at a full circumferential angle in case of 360 degree-revolution of the rotary assembly;

two vertical oscillating means disposed between the fixed arm of the rotary assembly and the member fans, each vertical oscillating means comprising a servomotor, a gear cluster, a crank, a connecting rod and a rocker lever, the servomotor together with the gear cluster disposed at the rear end of the motor of the rotary assembly by virtue of a bracket, the crank having a first end for connecting with the gear cluster, the connecting rod fixed to a second end of the crank, the rocker lever having a first end connected to the connecting rod and a second end fixed to the fixed arm of the rotary assembly, the servomotor of the vertical oscillating means applied to effecting differential rotation of the gear cluster so as to drive the crank, and thus further driving the connecting rod as well as the rocker lever for effecting vertical oscillation of the respective member fans;

a speed control device disposed between the rotary assembly and the shaft of the down rod assembly, which including a motor, a gear cluster and a current control unit, the current control unit electrically connected with the motor and then together with the motor as well as the gear cluster to be mounted together on a mounting bracket, the mounting bracket fixed to the rotary assembly, the gear cluster meshing closely with a central axial gear which located on a lower portion of the shaft, the current control unit serving to control output current, such that during the operation of the motor, a changeable and controllable revolution torque can be produced by the differential motion of the gear cluster, such that the revolution speed can be control.

2. The multi-fan assembly as claimed in claim 1, wherein each member fans of the rotary assembly is fixed to the fixed arm respectively by virtue of a hanging device, the hanging device having low friction for enabling the free vertical oscillation of the member fans.

3. The multi-fan assembly as claimed in claim 1, wherein the servomotor in the oscillating means can be electrically connected to a current control unit for controlling the frequency of the vertical oscillation of the member fans.

* * * * *